United States Patent [19]

Farrar et al.

[11] Patent Number: 4,729,743

[45] Date of Patent: Mar. 8, 1988

[54] FILTERED ELECTRICAL CONNECTOR

[75] Inventors: John C. Farrar, Harrisburg; Robert J. McLean, Elizabethtown; James L. Schroeder, III, Palmyra; Patrick F. Yeager, Middletown, all of Pa.

[73] Assignee: AMP Incorporated, Harrisburg, Pa.

[21] Appl. No.: 880,235

[22] Filed: Jun. 30, 1986

Related U.S. Application Data

[63] Continuation-in-part of Ser. No. 758,711, Jul. 26, 1985.

[51] Int. Cl.[4] ..... H01R 13/719

[52] U.S. Cl. ..... 439/276; 439/620

[58] Field of Search ..... 333/182, 183; 339/143 R, 147 R, 147 P; 439/271-277, 607-610, 620-622

[56] References Cited

U.S. PATENT DOCUMENTS

| | | | |
|---|---|---|---|
| 3,452,252 | 6/1969 | Mapham | 317/16 |
| 3,961,294 | 6/1976 | Hollyday | 339/143 R |
| 4,070,084 | 1/1978 | Hutchison | 339/143 R |
| 4,106,839 | 8/1978 | Cooper | 339/143 R |
| 4,126,370 | 11/1978 | Nijman | 339/143 R |
| 4,144,509 | 3/1979 | Boutros | 339/181 |
| 4,198,613 | 4/1980 | Whitley | 333/181 |
| 4,262,268 | 4/1981 | Shimada et al. | 333/182 |
| 4,330,166 | 5/1982 | Cooper et al. | 339/143 R |
| 4,365,282 | 12/1982 | Brainard | 361/127 |
| 4,407,552 | 10/1983 | Watanabe et al. | 339/143 R |
| 4,458,220 | 7/1984 | Carter et al. | 339/147 R |
| 4,484,159 | 11/1984 | Whitley | 333/182 |
| 4,494,092 | 1/1985 | Griffin | 333/182 |
| 4,580,866 | 4/1986 | Hagner | 339/147 R |
| 4,582,385 | 4/1986 | Couper et al. | 339/147 R |
| 4,600,256 | 7/1986 | Anttila | 339/143 R |
| 4,600,262 | 7/1986 | Nieman et al. | 339/147 R |

FOREIGN PATENT DOCUMENTS 2119182 11/1983 United Kingdom .

*Primary Examiner*—John McQuade

*Attorney, Agent, or Firm*—Katherine A. Nelson

[57] ABSTRACT

An electrical connector is provided which has both transient suppression and filtering means for protecting electronic equipment from energy generated by RFI, EMI, EMP and ESD. The connector is comprised of a conductive housing member having an axially extending passageway therethrough, and a circuit assembly disposed therein, the circuit assembly including a transient suppression subassembly and a pi-network filter assembly in electrical engagement with a plurality of electrical terminals. The transient suppression subassembly is comprised of a dielectric substrate having conductive path disposed thereon, a plurality of apertures extending therethrough for receiving electrical terminal members and preferably a bidirectional diode electrically connected to the terminal members and conductive path means and grounding means. The filter assembly, comprised of capacitor and inductor members is electrically engageable with the terminal members and ground. The connector is further provided with sealing members to provide protection from the environment.

16 Claims, 17 Drawing Figures

FILTERED ELECTRICAL CONNECTOR

This application is a continuation-in-part of application Ser. No. 758,711 filed July 26, 1985.

FIELD OF THE INVENTION

This invention relates to electrical connectors and more particularly to electrical connectors and terminals providing protection against electromagnetic interference, radio frequency interference and especially against power surges owing to electrostatic discharges and electromagnetic pulses.

BACKGROUND OF THE INVENTION

Electrical circuitry often must be protected from disruptions caused by electromagnetic interference (EMI) and radio frequency interference (RFI) entering the system. In addition to protecting electronic equipment against EMI/RFI energy there is also a need to protect the equipment against power surges owing to electrostatic discharges (ESD) and electromagnetic pulses (EMP). The high voltage generated by ESD and EMP can damage voltage sensitive integrated circuits and the like.

Frequently today's electronic circuitry requires the use of high density, multiple contact electrical connectors. There are many applications in which it is desirable to provide a connector with a filtering capability; for example, to suppress EMI and RFI, and transient suppression means to suppress EMP and ESD interference or other undesired signals which may exist in circuits connected by the connectors. To retain the convenience and flexibility of the connector, however, it is desirable that the filtering capability be incorporated into the connectors in a manner that will permit full interchangeability between the filtered connectors and their unfiltered counterparts. In particular, any filtered connector should retain substantially the same dimensions as the unfiltered version and should have the same contact placement so that either can be connected to appropriate mating connectors.

One means to protect against undesirable interference is by the use of shielding. One such shielding means is disclosed in U.S. Pat. No. 4,330,166. This patent discloses the use of a conductive spring washer seated in the plug portion of the connector so as to make electrical contact with the receptacle portion of the connector when the plug and receptacle are mated. One washer thus provides shielding for a multitude of electrical circuits. For adequate protection, it is essential therefore that there be no break in the continuity of the shielding.

Means for protecting against power surges include the use of additional specialized circuitry within equipment, such as voltage variable resistors.

Protection against power surges can also be achieved by the use of connectors having transient suppression devices associated with selected terminals within the connector, such as the connectors disclosed in U.S. patent application Ser. No. 758,712, entitled "Transient Suppression Device" and U.S. patent application Ser. No. 758,711 entitled "Transient Suppression Assembly" commonly owned by this assignee.

It is an object of the present invention to provide an EMP/ESD protected as well as EMI/RFI filtered electrical connector.

It is a further object of this invention to provide EMP and EMI protection for high density, multi-contact electrical connectors.

It is also an object of this invention to provide a method for assembling a filtered connector that at least in part lends itself to automatic equipment such as robotics.

Further it is an object of this invention to provide EMP and EMI protection for electrical connectors such that the protected connectors retain substantially the same dimensions and contact placement as their unprotected mateable counterparts.

It is an additional object of this invention to provide an environmentally sealed connector.

SUMMARY OF THE INVENTION

In accordance with the present invention, an electrical connector is provided which has both transient suppression and filtering means and preferably includes sealing members for environmentally sealing the connector. The connector is comprised of a conductive housing member having an axially extending passageway therethrough and a circuit assembly disposed therein, the circuit assembly including a transient suppression subassembly and a filter means in electrical engagement with a plurality of electrical terminals. The transient suppression subassembly is comprised of a dielectric substrate member having a conductive path means disposed thereon, a plurality of apertures, extending therethrough for receiving a plurality of electrical terminals, transient suppression means electrically connectable to the terminals and conductive path means and grounding means for grounding the transient suppression subassembly. The filter means is comprised of a capacitor and inductor members electrically engagable with the electrical terminals and means for grounding the filter means. Sealing members are disposed at both ends of the housing passageway to provide protection from the environment.

In accordance with the invention the circuit assembly is constructed such that grounding paths from the transient suppression subassembly and filter means to the housing member are provided automatically when the circuit assembly is positioned within the housing. Solder or conductive epoxy may be used to provide permanent connections.

According to the presently preferred embodiment, the filter means comprises a pi-section LC filter containing a pair of monolithic planar capacitors which are electrically coupled to the terminals and conductive portion of the capacitors. The conductive portion of at least one of the planar capacitors engages the conductive housing member when the circuit assembly is inserted into the housing. Preferably solder or conductive epoxy is used to connect the second capacitor to the housing.

Some of the objects and advantages of the invention having been stated, others will appear as the description proceeds when taken in connection with the accompanying drawings.

DESCRIPTION OF THE PREFERRED EMBODIMENT

Figure 1:
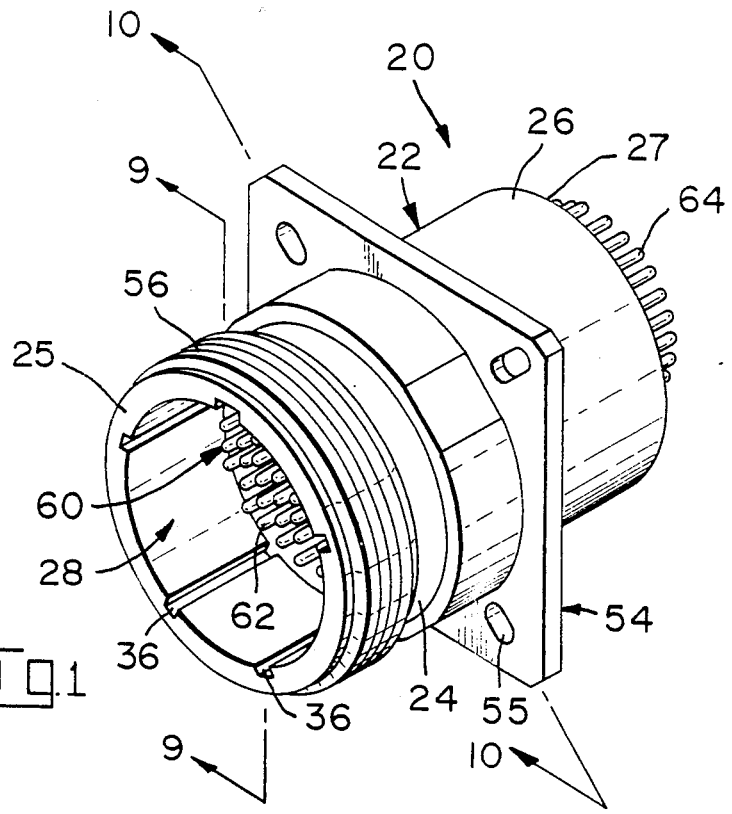
FIG. 1 is a perspective view of the assembled connector.
Figure 3A:
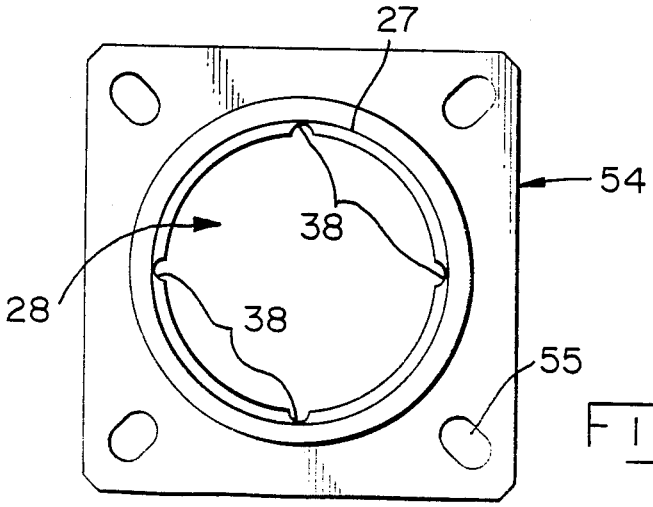
FIG. 3A is a rear plan view of the connector.
Figure 2:
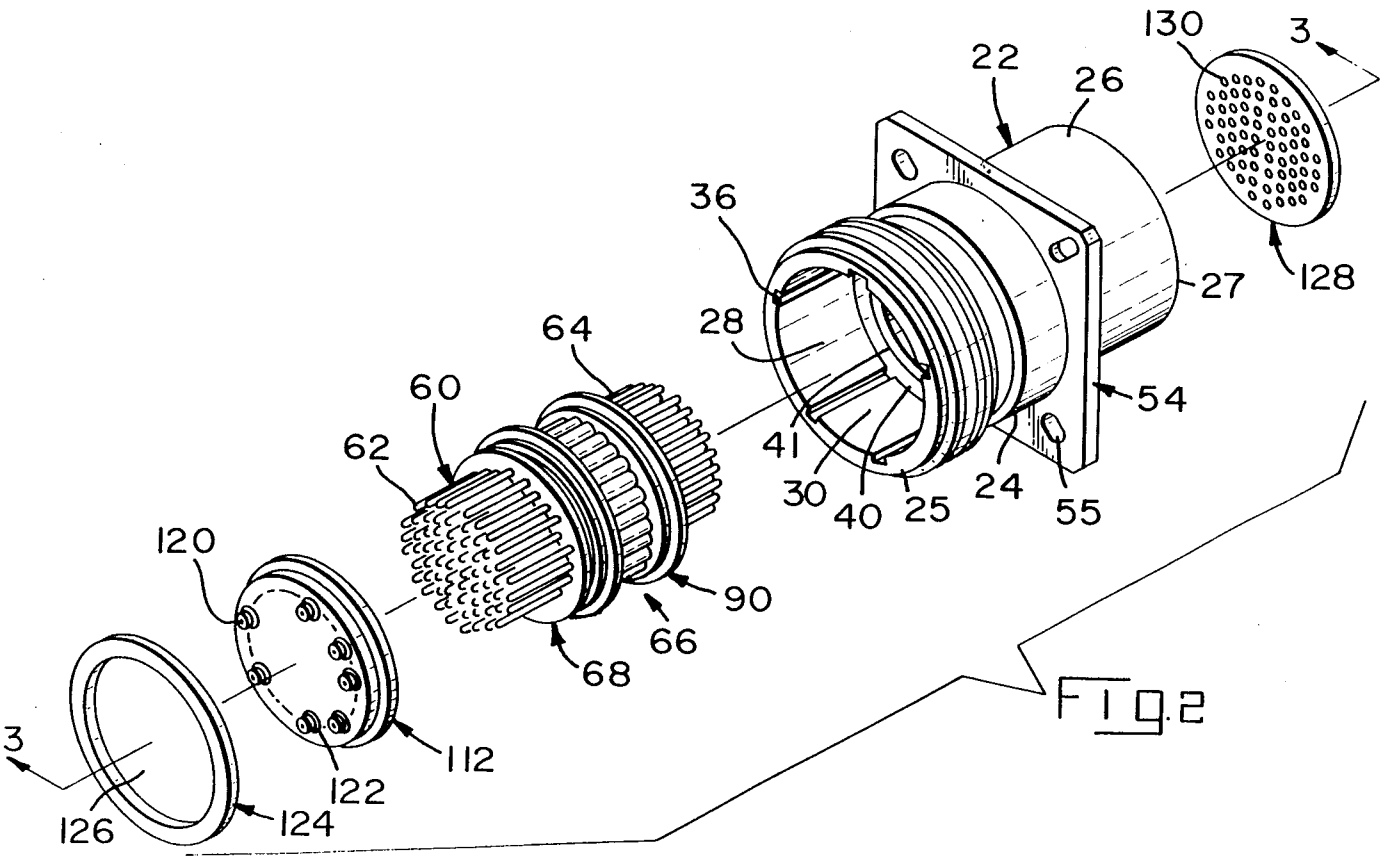
FIG. 2 is an exploded perspective view of the connector of view 1.
Figure 3:
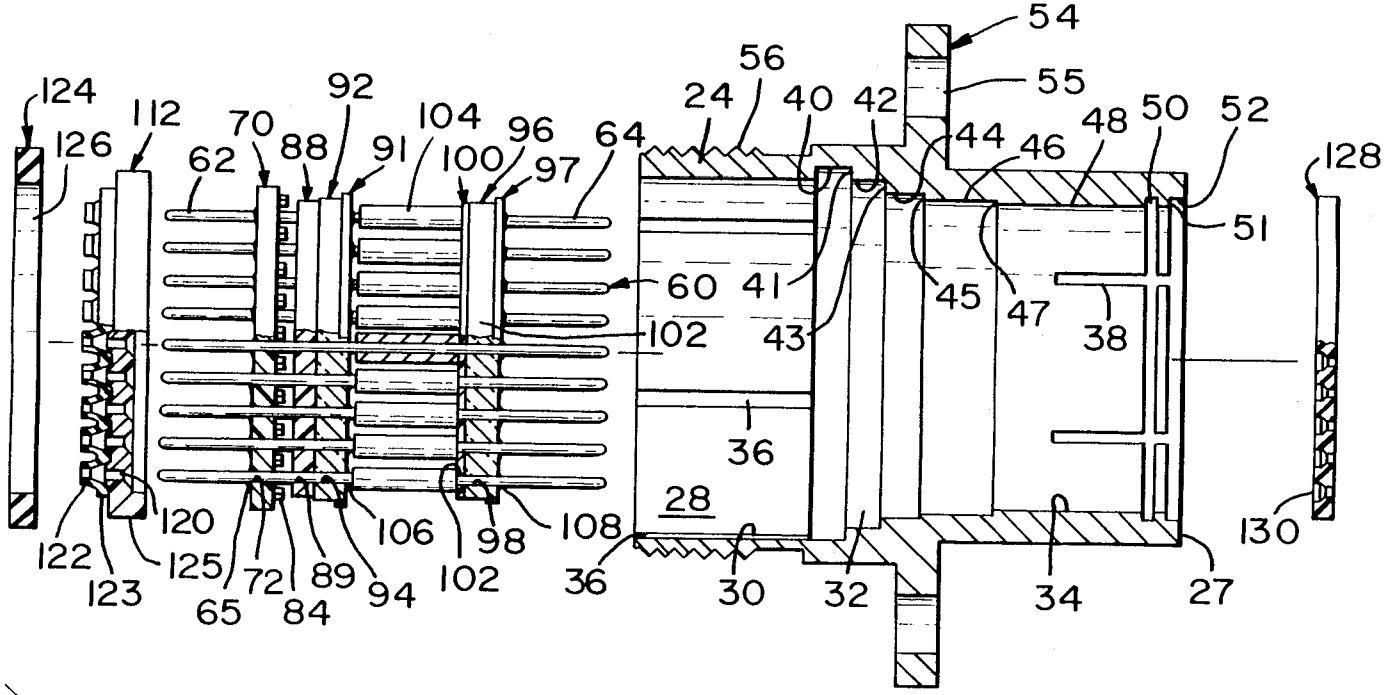
FIG. 3 is an exploded longitudinal section view taken along the line 3—3 of FIG. 2.
Figure 4:
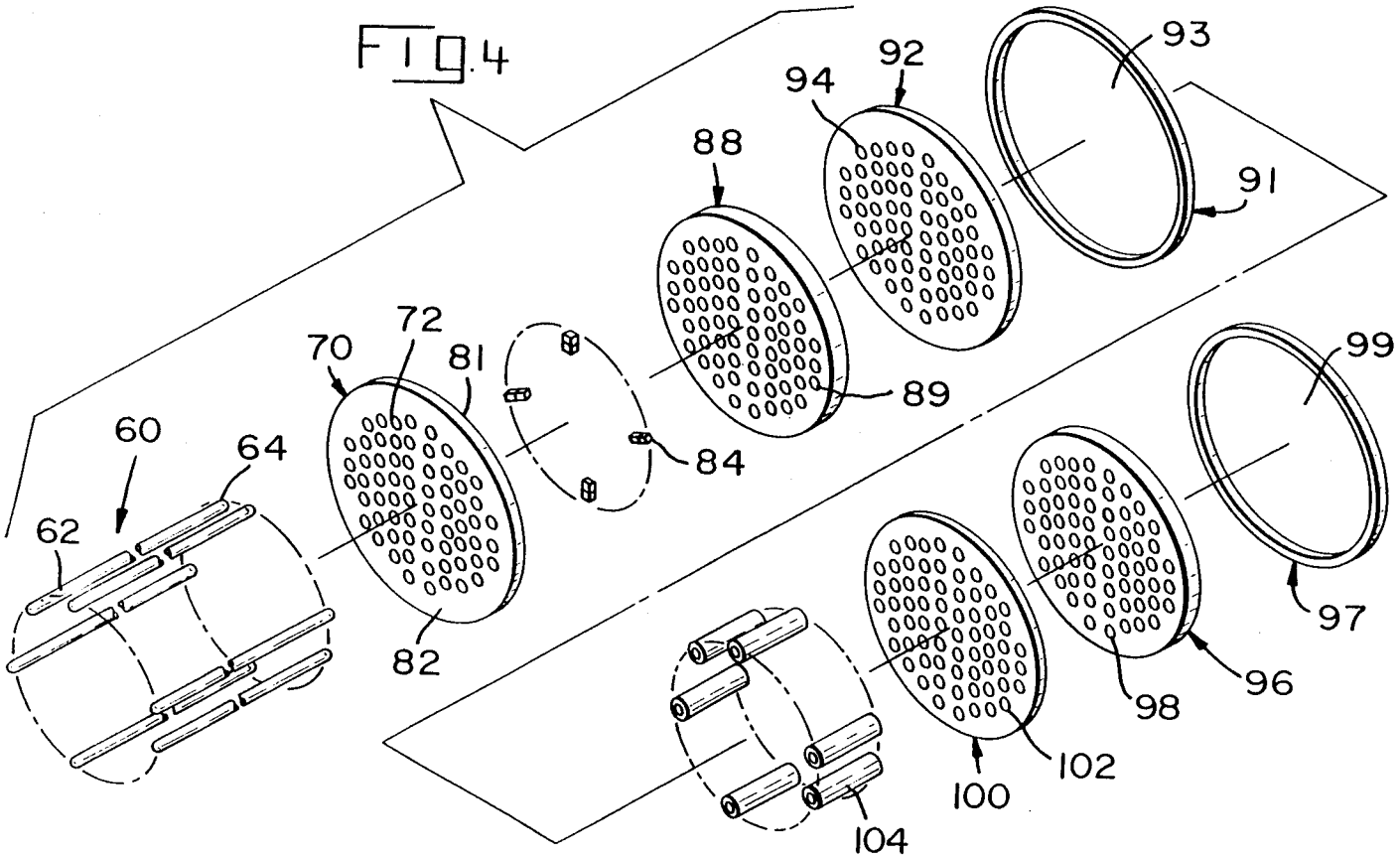
FIG. 4 is an exploded perspective view of the circuit assembly.
Figure 5:
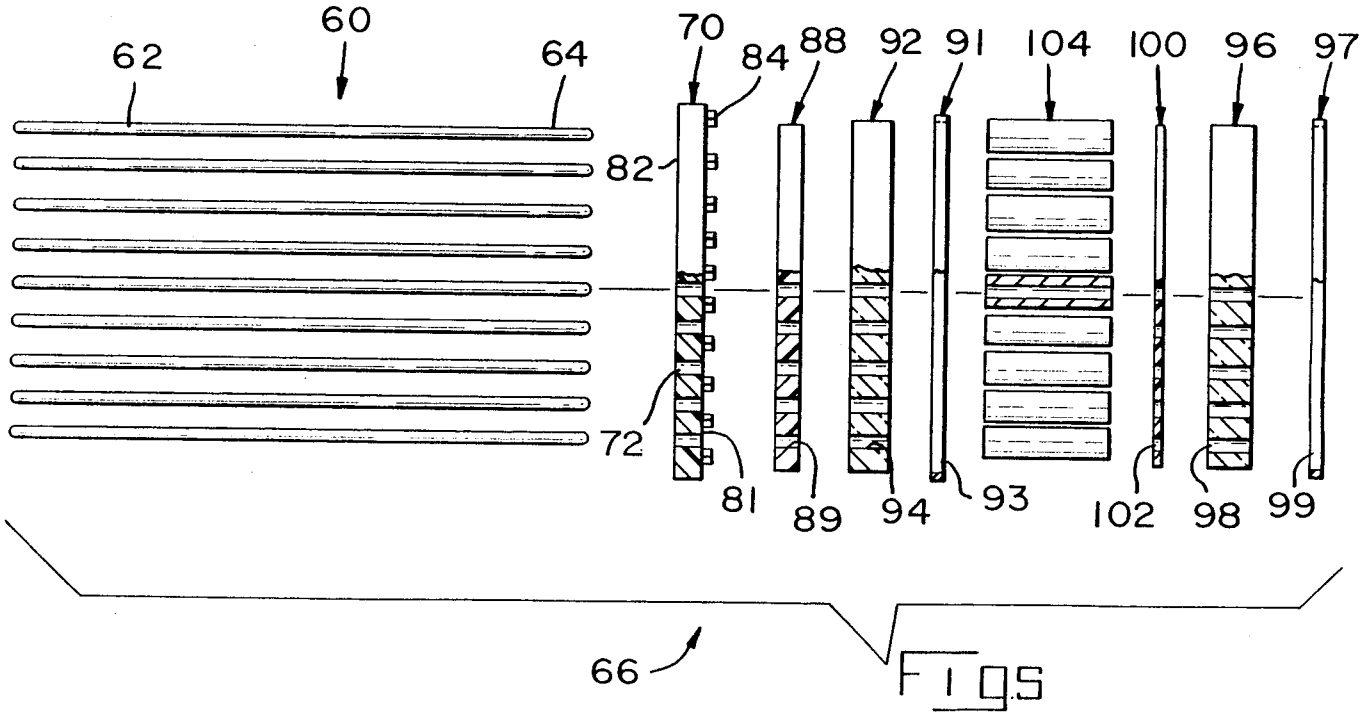
FIG. 5 is an exploded longitudinal section view of the circuit assembly having portions of the internal parts broken away.
Figure 10:
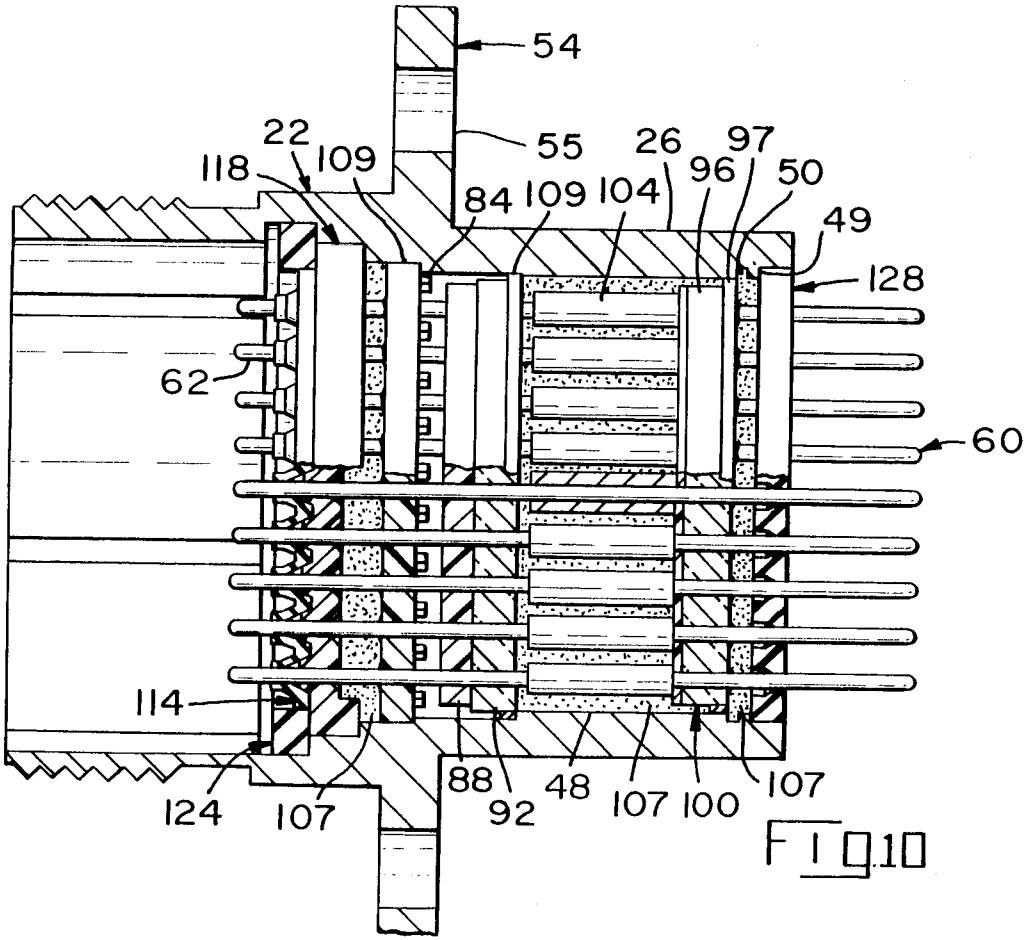
FIG. 10 is a longitudinal section view of the assembled connector taken along line 10—10 of FIG. 1 and having portions of the internal parts broken away.

Referring now to FIGS. 1, 2, and 3, electrical connector 20 is comprised of a conductive housing member 22, and a circuit subassembly 66 comprised of a plurality of electrical terminals 60, transient suppression subassembly 68 and filter means 90. The connector preferably also includes front sealing means 112 and rear sealing means 128 to environmentally seal the connector. The connector may also be potted as is shown in FIG. 10. Housing member 22 is comprised of front portion 24 and rear portion 26 and has passageway 28 extending therethrough. Passageway 28 is profiled to have a plurality of grooves and recesses for receiving various portions of circuit assembly 66. Housing member 22 in the presently preferred embodiment is composed of nickel plated aluminum. Connector 20 comprises a receptacle connector, and as is known to those skilled in the art, is adapted to be mated with a complementary plug connector (shown in FIG. 11) to complete electrical circuits through the connector. It is to be understood that the round configuration is intended to be exemplary only, and is not intended to restrict the invention to any particular configuration.

The front or first portion of passageway 28 extends inwardly from front face 25 of housing member 22 and has a keying means comprised of a plurality of channels 36 for receiving and aligning mating connectors. Intermediate portion 32 of passageway 28 is comprised of an annular groove 40 and a plurality of annular recesses 42, 44, 46 and 48 which decrease in size progressively from front portion 24 to rear portion 26 of housing 22. Annular groove 40 and recesses 42, 44 and 46 have stop surfaces 41, 43, 45 and 47 respectively.

Figure 11:
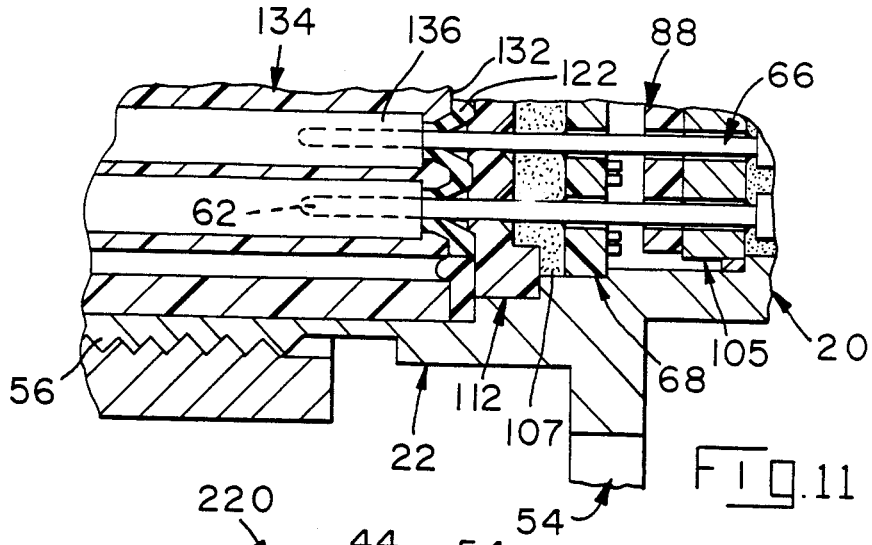
FIG. 11 is a fragmentary longitudinal section view of the connector mated with a complementary connector.

Recess 48 forms the rear portion 34 of passageway 28. Rear portion 34 further includes a second annular groove 50 and annular recess 52 which extends inwardly from rear housing face 27. Annular recess 52 has stop surface 51. Rear portion 34 further has a plurality of channels 38 which extend inwardly from rear face 27 into rear portion 34. Channels 38 are used to insert potting material into the assembled connector 20. Channels 38 are best illustrated in FIGS. 3 and 3A. The connector housing 22 further has mounting means 54 extending outwardly therefrom, having apertures 55 extending therethrough for mounting connector 20 to a back panel. Housing 22 also has retaining means 56 for interlocking with a mating connector (as shown in FIG. 11).

Figure 6:
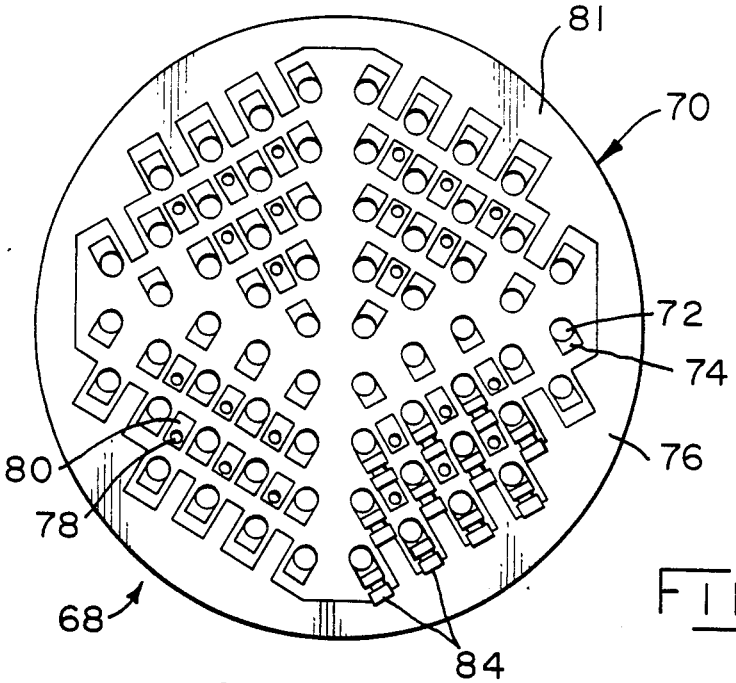
FIG. 6 is a top plan view of the substrate member of the transient suppression subassembly.
Figure 7:
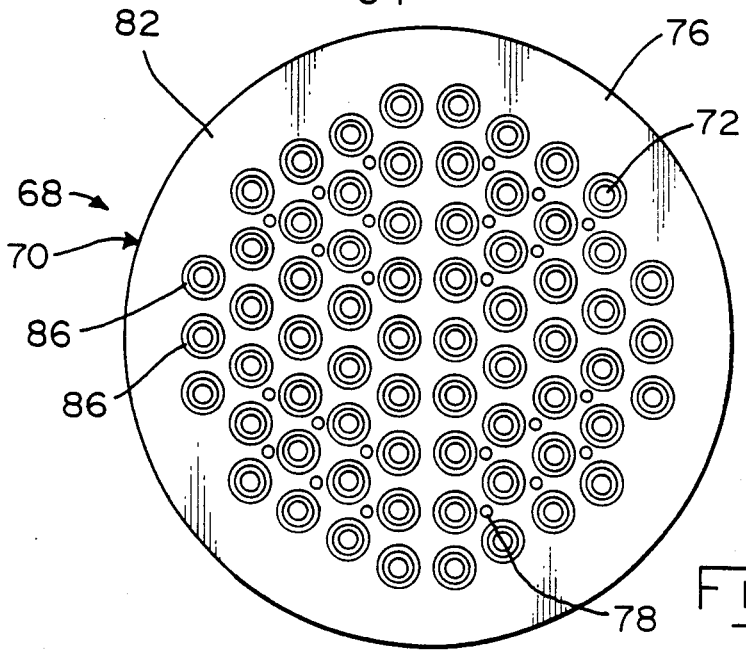
FIG. 7 is a bottom plan view of the substrate member of the transient suppression subassembly.

FIGS. 2 through 7 illustrate construction of circuit subassembly 66 which is comprised of transient suppression subassembly 68, filter means 90 and electrical terminal members 60. Transient suppression subassembly 68 is comprised of dielectric substrate 70, as best seen in FIGS. 6 and 7, having first major side 81 and second major side 82. Substrate 70 has a plurality of first and second apertures 72, 78 respectively extending therethrough. First apertures 72 are plated through holes for receiving first contact portions 62 of electrical terminals 60 and are located in peripheral and central regions of substrate 70. Conductive pad 74 surrounds at least a portion of each aperture 72. Second apertures 78 are plated through holes comprising portions of ground paths having a ground pad 80 surrounding said second apertures 78. For purposes of clarity second apertures 78 are shown in FIGS. 6 to 7 only. Conductive ground path 76 is disposed around the peripheral side portions of first major side 81, the majority of second major side 82 and along the circumferential edge of substrate 70. The large ground path area maximizes the current carrying capability of the diode to ground. Isolation paths 86 on side 82 are comprised of areas of unplated substrate provided around each of the terminal receiving apertures 72 to isolate the terminals 60 from ground path 76. Transient suppression means 84 are mounted to side 81 of substrate 70 to electrically interconnect conductive pad 74 to ground path 76 or ground pad 80. Heat generated by operation of the transient suppression means 84 is dissipated into substrate 70. Transient suppression means 84 are preferably bidirectional surface mounted diodes such as those disclosed in U.S. patent application Ser. Nos. 758,712, 758,711 and 859,126. Unidirectional diodes may also be used.

Figure 6A:
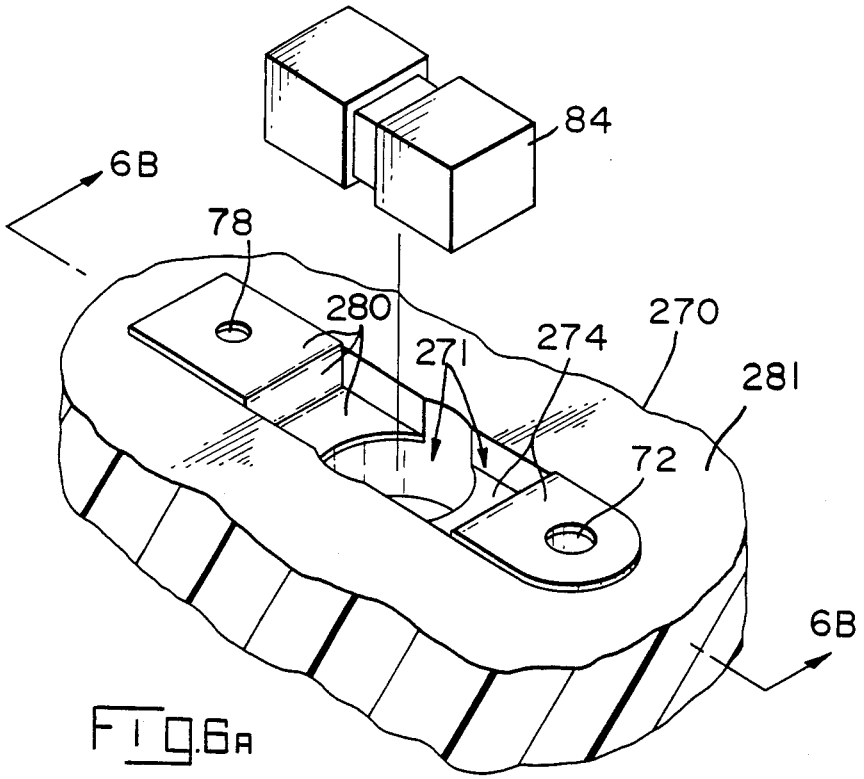
FIG. 6A is an exploded fragmentary view of an alternative method for forming the transient suppression subassembly.
Figure 6B:
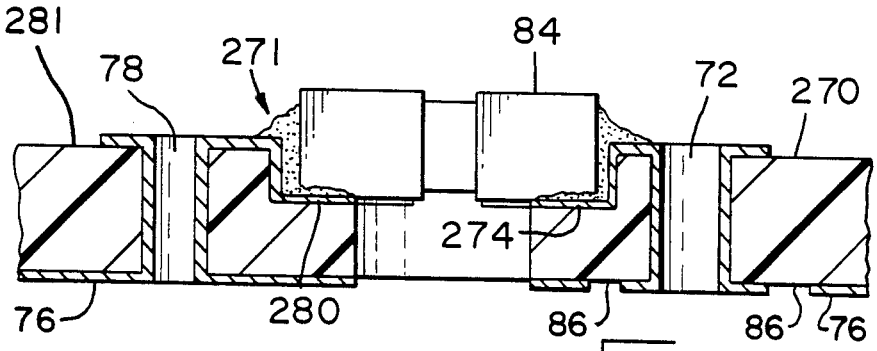
FIG. 6B is a longitudinal section view taken along line 6B—6B of FIG. 6A.
Figure 6C:
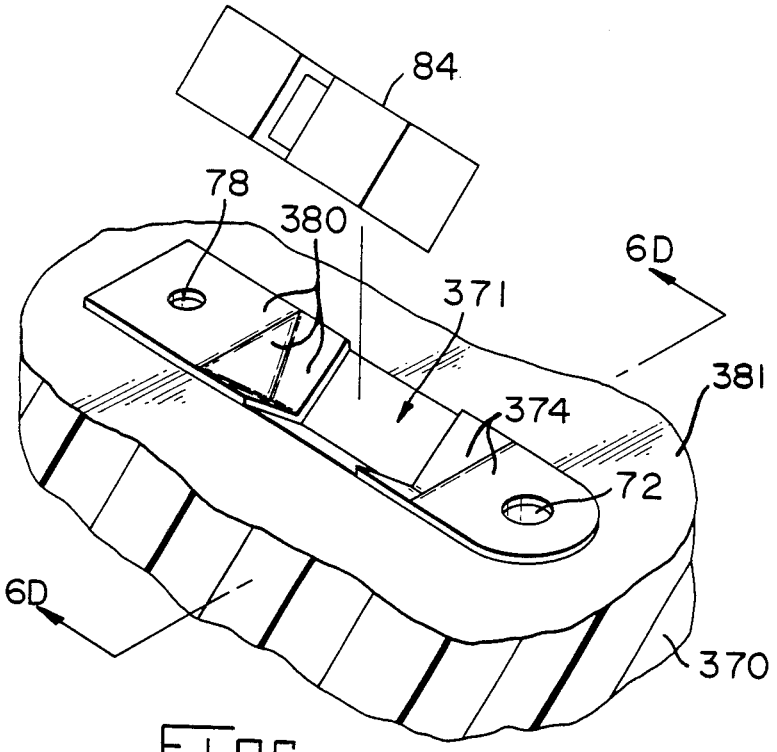
FIG. 6C is an exploded fragmentary view of a further alternative method for forming the transient suppression subassembly.
Figure 6D:
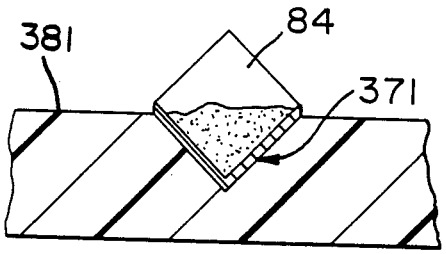
FIG. 6D is a longitudinal section view taken along line 6D—6D of FIG. 6C.

Alternatively, the transient suppression means 84 may be mounted to dielectric substrates 270, 370 as shown in FIGS. 6A through 6D. In these embodiments, first surface 281, 381 of substrates 270, 370 are formed with a plurality of indentations 271, 371 for receiving transient suppression means 84. Surfaces 281, 381 are plated in the same manner as previously described for surface 81 except that conductive paths 274, 374 and ground pads 280, 380 extend into indentations 271, 371 respectively. Transient suppression means 84 may be mounted along a flat edge as shown in FIGS. 6A and 6B or at an angle as shown in FIGS. 6C or 6D. The use of indentations 271, 371 for properly locating transient suppression means 84 is particularly useful in automated manufacturing systems such as robotic systems. The indentations provide a process for surface mounting that is highly reliable, repeatable and cost effective.

Indentations 271, 371 may be molded into the substrate by means known in the art.

To assemble transient suppression subassembly 68, transient suppression diodes are secured and electrically connected to side 81 of substrate 70 by means of solder or conductive epoxy. The first contact portions 62 of the electrical terminals 60 are then inserted into respective apertures 72 and soldered to side 82 at 65 as seen in FIG. 3. To ensure integrity of subassembly 68, it is preferable to use a higher temperature solder to mount the diodes than that used for mounting the terminals. To protect the mounted diodes from contamination during further handling in the manufacturing process, they may be encapsulated with an epoxy material.

Referring again to FIGS. 4 and 5, insulator spacer member 88 having apertures 89 extending therethrough is now inserted over second connecting portions 64 of terminals 60 to isolate the transient suppression assembly 78 from the filter means 90. Filter means 90 is then assembled onto a second connecting portions 64 of the terminals. The filter means 90 comprises a pi-section LC filter assembly commonly used in electrical filtering applications and need not be described in detail herein. Details of such a filter assembly are, however, fully disclosed in U.S. Pat. No. 4,262,268. Briefly, the filter assembly 90 comprises a pair of monolithic planar capacitors 92 and 96 between which is positioned a plurality of magnetic tubular elements such as ferrite tubes 104. Planar capacitors 92 and 96 each have a plurality of apertures, 94 and 98, respectively, and contacts 60 extend through the apertures 94 and 98 and through the ferrite tubes 104. Each contact 60 is mechanically and electrically coupled at 106 to planar capacitor 92 and at 108 to planar capacitor 96 by a conductive solder as illustrated in FIG. 3. An insulating sheet 100 of, for example, unclad epoxy glass laminate may be positioned against inner surface of planar capacitor 96. Insulating sheet 100 also contains a plurality of apertures 102 through which contacts 60 extend.

As is described in U.S. Pat. No. 4,262,268, filter means 90 functions as an LC circuit with the ferrite tubes providing inductances in connection with contacts 60, and such a filter is highly effective in filtering EMI and RFI interference from circuits connected through connector 20.

In the preferred method of manufacturing filter means 90, first and second capacitors 92, 96 are identical in size. The size difference required by the location of capacitors 92, 96 in the assembled connector is adjusted by means of conductive ring members 91 and 97 having apertures 93, 99 secured to capacitors 92, 96 respectively. Ring member 91 is dimensioned to be received in recess 46 and positioned against surface 47. Ring member 93 is dimensioned to be received in recess 48. It is to be understood that first and second capacitors 92, 96 could be sized to fit directly in their respective locations.

To assemble filter means 90, second connecting portion 64 of terminal 62 is inserted through apertures 94 of first monolithic capacitor 92 having ring member 91 secured thereon and soldered thereto at 106. Magnetic tubular elements 104 are then mounted onto each of the electrical terminals 60. Second monolithic capacitor 96 having apertures 98 extending therethrough is then slid over second connecting portions 64 of terminal 60. If desired an insulating sheet 100 having apertures 102 therein may also be mounted to terminals 60 prior to mounting second capacitor 96. Electrical terminals 60 are soldered at 108 to complete the construction of filter means 90.

Figure 8:
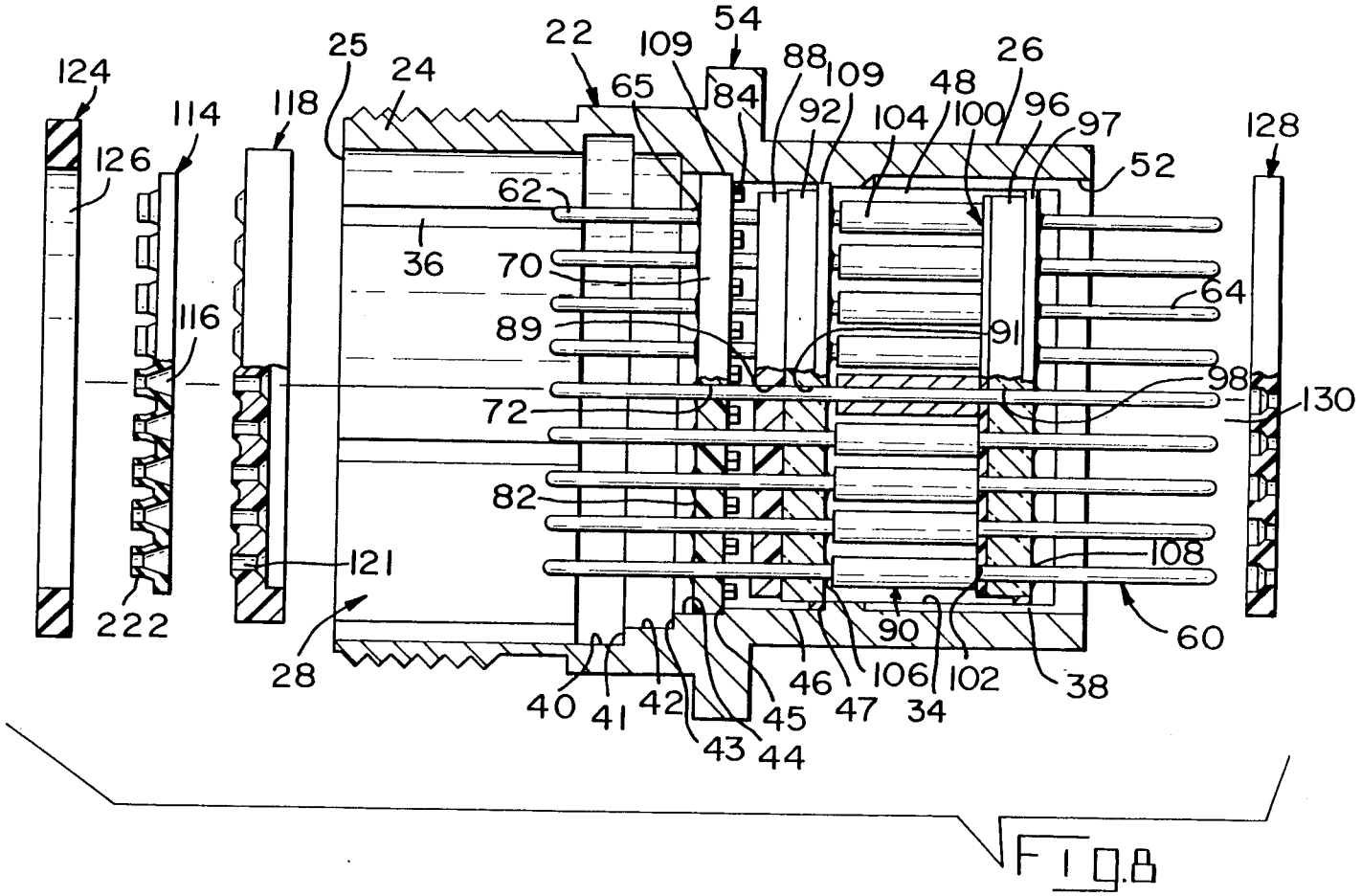
FIG. 8 is a longitudinal section view of the circuit assembly inserted into the housing member with the sealing members exploded therefrom.
Figure 9:
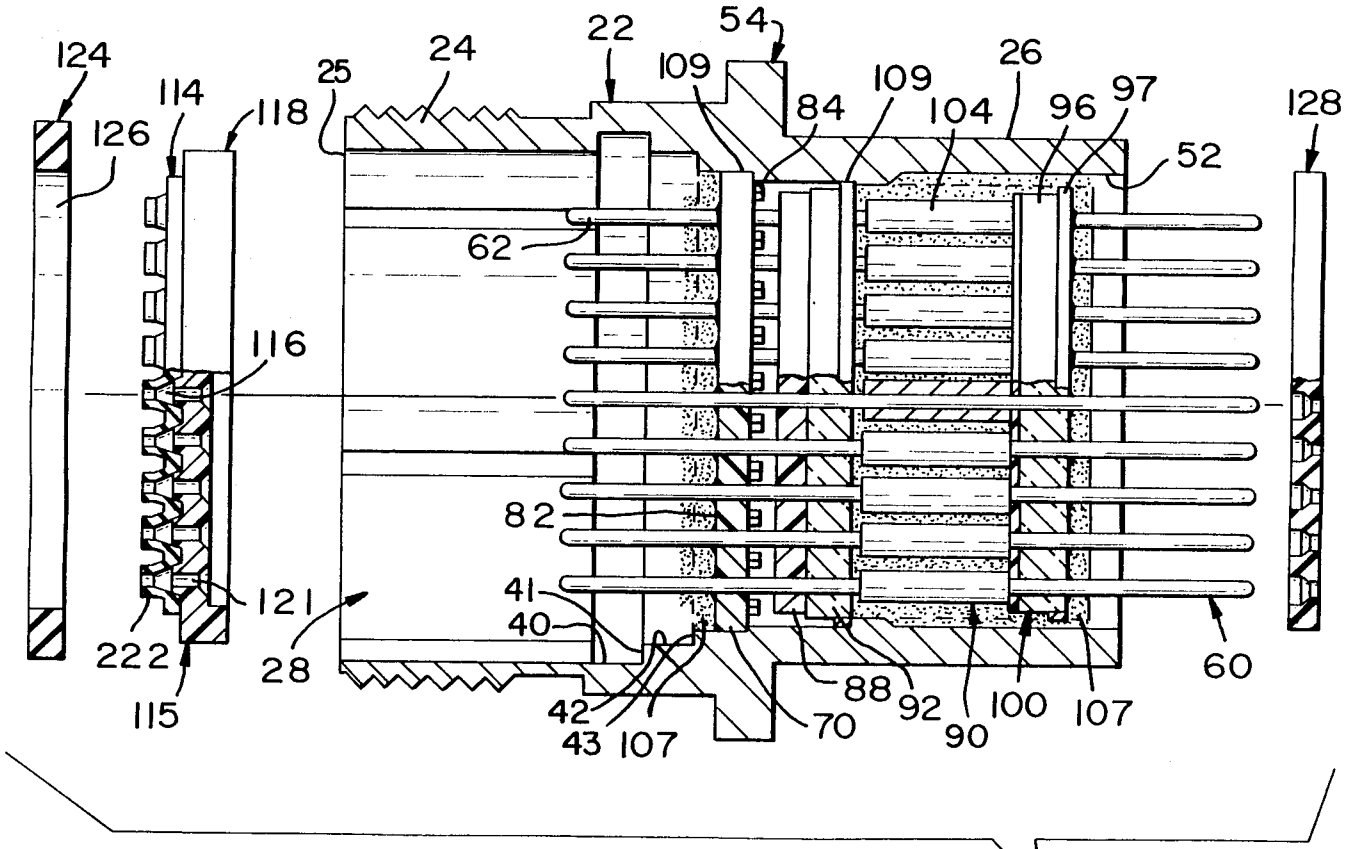
FIG. 9 is a longitudinal section view taken along line 9—9 of FIG. 1 and illustrating the locations of potting material.

FIGS. 8 through 10 illustrate further assembly of the connector 20. After completing the circuit subassembly 66, it is inserted into housing member 22 from front face 25 so that the filter means 90 rests in the rear portion 34 of passageway 28. The dimensions of the dielectric substrate 70 of transient suppression assembly 68 and the conductive rings 91 and 97 of filter means 90 are sized to be received in the housing and rest on stop surfaces 45 and 47 respectively. The circuit subassembly 66 is electrically grounded to the housing member by use of solder or preferably conductive epoxy applied at stop surfaces 45, 47 and in recess 48 to connect ring 97 to housing 22. Potting material 107 is then inserted from front housing portion 24 into the area adjacent second major side 82 of substrate member 70 of the transient suppression subassembly 68, and also into rear housing portion 26 through channels 38 into the area surrounding the magnetic tubular elements 104 and adjacent the rearwardly facing surface of circuit subassembly 66. The potting material is a dielectric adhesive material which will seal the assembly from moisture and environmental corrosion.

Since there are a number of soldering steps in assembly of this connector, it is preferable that solders having different temperatures are used to maintain the integrity of the system. The higher temperature solders are used first, followed by successively lower temperature activated solders. For purposes of illustration pins and sockets were used for this connector. It is to be understood that solder cups, wire wraps or other connector contacts may be used in accordance with the invention.

Referring especially to FIGS. 3 and 8, this front sealing assembly may be molded as an integral unit 112 having first and second sections 123, 125, as shown in FIG. 2 or as comprising first and second portions 114, 118 which are adhered together to form assembly 115 as shown in FIGS. 8 and 9. Front sealing assembly 112 has a plurality of apertures 120 extending therethrough and cone shaped protrusions 122 extending forwardly therefrom, the cone shaped protrusions 122 being formed around the forward end 127 of each of said apertures 120.

Portions 114, 118 of front sealing assembly 115 have apertures 116, 121 respectively extending therethrough, respective apertures 116 and 121 being aligned to form a continuous aperture through the assembled unit. Portion 114 further has a plurality of cone shaped protrusions 222 extending forwardly therefrom in the same manner as previously described for assembly 112.

To ensure maximum sealing capabilities when mated to a complementary connector, it is preferred that first section 123 of assembly 112 and first portion 114 of assembly 115 be molded from a resilient material and second section 125 of assembly 112 and second portion 118 of assembly 115 be molded from a more rigid material. The combination of materials permits the resilient protrusions 122, 222 respectively to sealingly press against the mating surfaces of a complimentary connector while the more rigid material provides a firm support surface for the resilient material. Selection of the desired materials will depend upon the environmental conditions under which the connector must function. In addition the compatibility of the two types of materials must be considered particularly when the single unit is being formed by a dual injection molding process or other means known in the art. A number of suitable materials are available commercially and are known in the art.

Front sealing assembly 112, 115 is mounted to the first connecting portions 62 of the terminals 60 such that the outer edge of section 125 or second portion 118 rests against stop surface 43 of housing member 22. Radial compression sealing ring 124 having an aperture 126 therein is then inserted into front portion 30 of passageway 28 until it locks into annular groove portion 40 of housing member 22. Radial sealing ring 124 is preferably made of a flexible material such as that used for first section 123 or first portion 114.

Rear sealing member 128 having a plurality of apertures 130 extending therethrough, is mounted to the second connecting portions 64 of terminals 60 and is seated against stop surface 52 of housing member 22. Rear sealing member 128 is made from a resilient material, preferably the same one used for the other flexible sealing members. Sealing members 112 or 115 and 128 provide an environmental seal for connector 20. The cones 122, 222 extending from sealing assembly 112, 115 respectively press against the front engaging surface of 142 of complementary connector 134 as is shown in FIG. 11.

Figure 12:
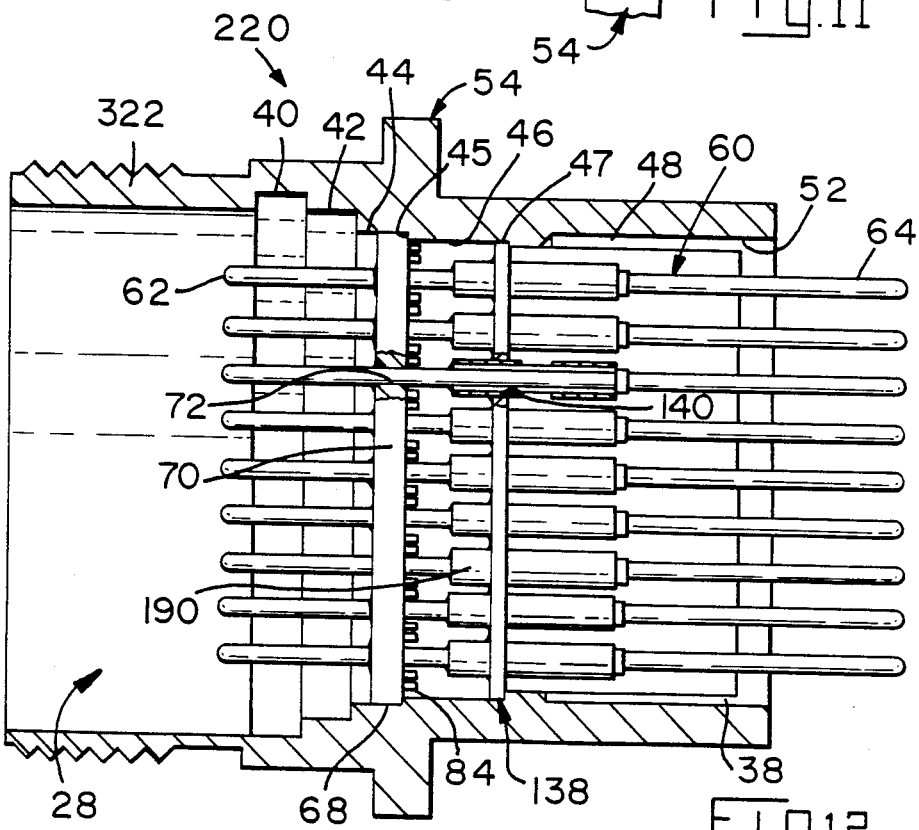
FIG. 12 is a longitudinal section view of an alternative embodiment of the connector.

FIG. 12 shows an alternative embodiment 220 of the present invention in which the filter subassembly is comprised of a tubular pi filter member 190 rather than a planar pi filter. the tubular pi filter member 190, having dual capacitor elements and an inductor element therein is mounted to each individual terminal 60 and soldered thereto. Filter members 190 are mounted into respective apertures 140 in a ground plate 138 and soldered thereto. Ground plate 138 is electrically connected to connector housing member 322 and stop surface 47 preferably by the use of solder or conductive epoxy. In this embodiment connector 220 is also potted and has the same sealing members as embodiment 20.

The invention disclosed herein provides superior performance in the suppression of transient voltage and further provides an environmentally sealed connector. The use of means for transient suppression in close proximity to the individual electrical terminal provides a short, minimum induction ground path for any transient signal. Minimum response time is thus assured. In addition the short ground path for the transient suppression minimizes interference with performance of the diode. By mounting this invention directly to the bulkhead it can prevent undesired energy from entering sensitive electronic systems.

In the drawings and specifications there has been set forth preferred embodiments of the invention, and although specific terms are employed, they are used in a generic and descriptive sense only, and not for purposes of limitation.

We claim:

1. A transient suppression subassembly for an electrical article, comprising:

a dielectric substrate member having opposed first and second major sides each having a peripheral region and a central region, and a plurality of peripheral and central apertures extending through said peripheral and central regions of said substrate member from said first major side to said second major side for receiving therethrough respective electrical terminal members, said substrate member having disposed on said first major side a plurality of discrete conductive path means associated with respective said peripheral and central terminal receiving apertures, each said conductive path means having a first path portion adapted to be electrically connected to a respective transient suppression means and a second path portion adapted to be electrically connected to a respective terminal disposed in an associated said terminal receiving aperture;

ground conductive means comprising first and second ground conductive surfaces associated with said first and second major sides respectively and means for electrically interconnecting said first and second ground conductive surfaces, said ground conductive means being exposed to be electrically engaged by ground means of said electrical article;

said first ground conductive surface being disposed on said peripheral region of said first major side and electrically isolated from said peripheral terminal receiving apertures and said discrete conductive path means, said first ground conductive surface having first ground portions each associated with and spaced a selected small distance from a respective said first path portion associated with a said peripheral terminal receiving aperture and adapted to be electrically connected to a respective transient suppression means;

said second ground conductive surface being disposed on and substantially covering said peripheral and central regions of said second major side of said substrate member and electrically isolated from said terminal receiving apertures;

said ground conductive means including second ground portions disposed on said central region of first major side each associated with and spaced a selected small distance from a respective said first path portion associated with a central terminal receiving aperture and adapted to be electrically connected to a respective transient suppression means;

said ground conductive means further including conductive aperture means extending from said second ground portions on said first major side to said second ground conductive surface on said second major side and establishing an electrical connector therebetween; and a plurality of transient suppression means secured to said first major side of said substrate member associated with respective said terminal receiving apertures and each electrically connected to a respective said first path portion and a respective one of a first and second ground portion associated with said respective first path portion for suppressing voltages outside a specified level as they are conductive along a respective said electrical terminal member secured in a respective said terminal receiving aperture when said ground conductive means is grounded by a said ground means, whereby an assured ground path is established between central ones of said transient suppression means and the periphery of said substrate member.

2. The transient suppression subassembly as defined in claim 1 wherein said first major side of said substrate member further includes a plurality of indentations located between first conductive path portions and their corresponding first or second ground portions, said indentations being adapted to receive said transient suppression means.

3. The transient suppression subassembly as defined in claim 2 wherein said transient suppression means is a bidirectional diode surface mounted in said indentations.

4. The transient suppression subassembly as defined in claim 3 wherein said transient suppression means is electrically connected to said substrate by means of conductive adhesive.

5. The transient suppression subassembly as defined in claim 3 wherein said transient suppression means is electrically connected to said substrate by means of solder.

6. The transient suppression subassembly of claim 1 in combination with:

a conductive housing member of an electrical connector, said housing member having a passageway extending axially therethrough, said dielectric substrate member of said transient suppression subassembly being disposed transversely in said passageway;

a plurality of electrical terminals disposed in electrical engagement with respective second portions of said conductive path means;

filter means comprising capacitor and inductor members in electrical engagement with and secured to said electrical terminals; and grounding means for grounding said filter means and said transient suppression subasssembly;

whereby upon establishment of a ground connection with said grounding means, voltages outside a specific level are suppressed as they are conducted through said terminals of said electrical connector.

7. The transient suppression subassembly in the combination of claim 6 and further in combination with sealing means for said connector, said sealing means comprising a front sealing assembly and a rear sealing member.

8. The transient suppression subassembly in the combination of claim 7 wherein said sealing means further includes potting material.

9. The transient suppression subassembly in the combination of claim 7 wherein said front sealing assembly of said connector is comprised of a first flexible portion and a second rigid portion.

10. The transient suppression subassembly in the combination of claim 6 wherein said filter means is a pi-network filter comprised of first and second capacitive substrates having a plurality of first and second apertures respectfully extending therethrough for receiving said plurality of electrical terminals and a plurality of magnetic tubular members, one such member being mountable on each of said plurality of electrical terminals, said first and second capacitive substrates being separated from each other on said plurality of said electrical terminals by said magnetic tubular members.

11. An improved transient suppression assembly for an electrical connector, the connector comprising a housing means including a plurality of electrical terminals therein and a dielectric substrate member secured within the housing means and having a like plurality of apertures extending therethrough through each of which extends a corresponding one of the terminals, the substrate member having a plurality of discrete conductive path means disposed on a surface thereof, the conductive path means having first and second portions, the first portions being adjacent respective ones of the apertures, and in electrical engagement with corresponding ones of the terminals disposed in the apertures, the substrate member further including ground conductive means electrically separate from the plurality of conductive path means, the ground conductive means extending to surface portions proximate the second portions of the conductive path means and to ground means of the housing means of the connector, the substrate member further including a like plurality of transient suppression components secured thereto each in electrical engagement with a second portion of a respective conductive path means and with a respective surface portion of the ground conductive means, said transient suppression assembly being characterized in that:

said substrate member further includes a plurality of indentations, said indentations being associated with each of said second conductive path portions and corresponding surface portions of the ground conductive means, said indentations having first and second opposed end surfaces, said first and second end surfaces of each said indentation having said second conductive path portions and said surface portions of ground conductive means disposed thereon, said indentation being dimensioned to receive a said transient suppression component therein, whereby a respective said component is insertable into said indentation and secured therein in electrical communication with said second conductive path portions and said surface portions of said ground conductive means of said substrate member.

12. A transient suppression substrate as defined in claim 11 wherein said transient suppression component is electrically connected to said substrate member by means of conductive adhesive.

13. A transient suppression substrate as defined in claim 11 wherein said transient suppression component is electrically connected to said substrate member by means of solder.

14. The transient suppression subassembly as defined in claim 1 wherein said transient suppression means is a bidirectional diode mounted to said substrate member.

15. The transient suppression subassembly as defined in claim 1 wherein said transient suppression means is a unidirectional diode mounted to said substrate member.

16. The transient suppression subassembly as defined in claim 2 wherein said transient suppression means is a unidirectional diode surface mounted in said indentations.

* * * * *

UNITED STATES PATENT AND TRADEMARK OFFICE

CERTIFICATE OF CORRECTION

PATENT NO. : 4,729,743

DATED : March 8, 1988

INVENTOR(S) : Farrar, et al

It is certified that error appears in the above-indentified patent and that said Letters Patent is hereby corrected as shown below:

Claim 11, Column 10, line 31, "indentation" should be --indentations--.

Signed and Sealed this

Eighth Day of June, 1993

*Attest:*

Michael K. Kirk

MICHAEL K. KIRK

*Attesting Officer*

*Acting Commissioner of Patents and Trademarks*